United States Patent [19]

Yoneda et al.

[11] Patent Number: 4,554,566

[45] Date of Patent: Nov. 19, 1985

[54] HEAT-SENSITIVE RECORDING MATERIAL

[75] Inventors: Junichi Yoneda; Akira Igarashi, both of Shizuoka, Japan

[73] Assignee: Fuji Photo Film Co., Ltd., Kanagawa, Japan

[21] Appl. No.: 653,108

[22] Filed: Sep. 21, 1984

[30] Foreign Application Priority Data

Sep. 21, 1983 [JP] Japan ..... 58-174977
Sep. 21, 1983 [JP] Japan ..... 58-174978
Sep. 28, 1983 [JP] Japan ..... 58-179782

[51] Int. Cl.[4] ..... B41M 5/18
[52] U.S. Cl. ..... 346/207; 346/209; 427/150; 427/151; 428/327
[58] Field of Search ..... 346/207, 208, 209; 427/150, 151, 152; 428/327, 341, 342, 913

[56] References Cited

FOREIGN PATENT DOCUMENTS 99696 8/1981 Japan ..... 346/207
93198 6/1982 Japan ..... 428/913
25988 2/1983 Japan ..... 346/207

*Primary Examiner*—Bruce H. Hess
*Attorney, Agent, or Firm*—Sughrue, Mion, Zinn, Macpeak, and Seas

[57] ABSTRACT

A heat-sensitive recording material is described, comprising a heat-sensitive recording layer containing an electron-donating colorless dye and an electron-accepting compound, said heat-sensitive layer being provided on a support member, and said heat-sensitive layer containing from 5 to 50% by weight, based on the total weight of the heat-sensitive layer-constituting components, of polymer particles having an average particle size of from 0.03 to 16 microns, selected from the group consisting of ethylene-α-olefin copolymer particles, low density polyethylene particles, and ethylene-vinyl acetate copolymer particles.

8 Claims, No Drawings

HEAT-SENSITIVE RECORDING MATERIAL

FIELD OF THE INVENTION

This invention relates to a heat-sensitive recording material. More particularly, the invention relates to a heat-sensitive recording material which comprises a particular heat-sensitive recording layer containing an electron-donating colorless dye and an electron-accepting compound, with said recording layer being provided on a support member.

BACKGROUND OF THE INVENTION

Heat-sensitive recording materials including an electron-donating colorless dye and an electron-accepting compound are disclosed, for example, in Japanese Patent Publication No. 14039/1970 (corresponding to British Patent 1,135,540) and Japanese Patent Publication No. 4160/1968. Heat-sensitive recording materials of this type are used in facsimile or printing out data from an electronic computer, for instance, and are advantageous, for example, in that they involve little or no maintenance requirement. However, rubbing with a nail, for instance, causes color development, which disadvantageously makes the recording face dirty; that is, fogging occurs due to friction.

Known methods for improving heat-sensitive recording materials with respect to fogging due to friction can roughly be classified into three groups.

Firstly, a method has been disclosed which comprises adding a wax to the coating mixture to thereby improve surface smoothness or slidability, and at the same time prevent the generation of the frictional heat and absorb the heat through softening of the wax. An example of the wax is polyethylene wax. See Japanese Patent Publication No. 14531/1975.

Secondly, a method is known for preventing fogging due to friction which comprises adding finely powdered starch or starch derivative to the heat-sensitive layer to thereby inhibit frictional heat generation in the neighborhood of color-developing component grains. See Japanese Patent Publication No. 5947/1976.

Thirdly, a method is known which comprises providing the heat-sensitive layer with polymer-coated particles of a substance capable of producing a decolorizing effect against the color developing materials used. Upon rubbing, the decolorizing substance oozes out and inhibits the color development. See Japanese Patent Publication (unexamined) No. 46786/1981.

These methods, however, have drawbacks. For instance, they cause decreases in density of the color developed upon use of the heat-sensitive recording material, and/or cause decreases in image retention, and hence are somewhat unsatisfactory. Moreover, they are not always satisfactory in their frictional fogging-preventing effect.

SUMMARY OF THE INVENTION

An object of the invention is to provide a heat-sensitive recording material much improved with respect to fogging due to friction while maintaining other performance characteristics such as high density color development upon printing.

The above object has been accomplished by providing a heat-sensitive recording material comprising a heat-sensitive recording layer containing an electron-donating colorless dye and an electron-accepting compound, said heat-sensitive layer being provided on a support member, and said heat-sensitive layer containing from 5 to 50% by weight, based on the total weight of the heat-sensitive layerconstituting components, of polymer particles having an average particle size of from 0.03 to 16 microns, selected from the group consisting of ethylene-α-olefin copolymer particles, low density polyethylene particles and ethylene-vinyl acetate copolymer particles.

DETAILED DESCRIPTION OF THE INVENTION

The ethylene-α-olefin copolymer, low density polyethylene, and ethylene-vinyl acetate copolymer to be used in accordance with the invention should be in a granular form, and, especially when they have an average particle size in the specific range of from 0.03 to 16 microns, they are very effective in preventing fogging due to friction, and hence suited for use in the practice of the invention.

The α-olefin which constitutes the ethylene-α-olefin copolymer to be used in accordance with the invention preferably contains from 3 to 20 carbon atoms and includes, among others, 1-butene, 1-pentene, 1-hexene, 4-methyl-1-pentene, 1-octene, 1-decene, 1-tetradecene, and 1-octadecene.

In the polyethylene to be used in accordance with the invention, when it is low density polyethylene and its particle size is within a specific range of 0.03 to 16 microns, it is very effective in preventing frictional fogging.

However, the use of a high density polyethylene generally results in less effective prevention of frictional fogging. The low density polyethylene to be used in the practive of the invention preferably has a density of not more than 0.94 g/cm$^3$.

In accorance with the invention, the polymer particles, such as ethylene-α-olefin copolymer particles, low density polyethylene particles and ethylene-vinyl acetate copolymer particles, are contained in the heat-sensitive recording layer in an amount of from 5 to 50% by weight, and preferably from 5 to 15% by weight, based on the total weight of the coating materials on said layer. At a level of less than 5% by weight, the frictional fogging-preventing effect will be slight. Conversely, if the addition level exceeds 50% by weight, adverse effects, such as a decrease in sensitivity, will be produced. As for the average particle size (volume average particle size), a preferred range is from 0.03 to 16 microns. When the average particle size is less than 0.03 micron, the effect of the addition is insufficient, and, conversely, when said size exceeds 16 microns, the flatness of the heat-sensitive color-developing layer will be deteriorated. A more preferred average particle size range is from 0.5 to 5 microns.

The electron-donating colorless dye to be used in practicing the invention includes triarylmethane compounds, diphenylmethane compounds, xanthene compounds, thiazine compounds and spiropyran compounds, among others. Examples of these include: triarylmethane compounds such as 3,3-bis(p-dimethylaminophenyl)-6-dimethylaminophthalide (i.e., crystal violet lactone), 3,3-bis(p-dimethylaminophenyl)phthalide, 3-(p-dimethylaminophenyl)-3-(1,3-dimethylindol-3-yl)pthalide, and 3-(p-dimethylaminophenyl)-3-(2-methylindol-3-yl)phthalide; diphenylmethane compounds such as 4,4'-bisdimethylaminobenzhydrin benzyl ether, N-halophenyl-leucoauramine, and N-2,4,5-trichlorophenyl-leuco-auramine; xanthene compounds such as rhodamine-B-anilinolactam, rhodamine (p-nitroanilino)lactam, rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluroran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran and 2-phenyl-6-diethylaminofluoran; thiazine compounds such as benzoyl leucomethylene blue and p-nitrobenzyl leucomethylene blue; spiropyran compounds such as 3-ethylspiro-dinaphthopyran, 3-benzylspiro-dinaphthopyran, 3-methyl-naphto-(3-methoxybenzo)-spiropyran and 3-propyl-spiro-dibenzopyran. These electrondonating colorless dyes may be used either singly or in admixture.

The electron-accepting compound includes, among others, phenolic compounds, organic acids and metal salts thereof, and hydroxybenzoic acid esters. In particular, phenolic compounds are preferred since they have a melting point close to the desired recording temperature and do not necessarily require the use of a low-melting compound, or, if they do, require only a small amount of such compound. Examples of electron-accepting compounds are specifically described in Japanese Patent Publication No. 14039/1970, Japanese Patent Publication No. 29830/1976, etc. Typical examples include 4-tertiary-butylphenol, 4-phenylphenol, 4-hydroxydiphenoxide, α-naphthol, β-naphthol, methyl-4-hydroxybenzoate, 2,2'-dihydroxybiphenyl, 2,2-bis(4-hydroxyphenyl)propane (bisphenol A), 4,4'-isopropylidenebis(2-methylphenol), 1,1-bis(4-hydroxyphenyl)cyclohexane, 1,1-bis(3-chloro-4-hydroxyphenyl)-2-ethylbutane, 4,4'-secondaryisobutylidenediphenol, benzyl 4-hydroxybenzoate, octyl 4-hydroxybenzoate, 3,5-di-tertiary-butylsalicylic acid and 3,5-di(α-methylbenzyl)salicylic acid.

In the practice of the invention, the heat-sensitive recording material can be produced, for example, in the following manner. Most generally, an electron-donating colorless dye such as mentioned above and an electron-accepting compound are separately dispersed in a 1–10 weight % solution of a water-soluble polymer by means of a ball mill, sand mill, or the like; the resulting dispersion, are blended, and an oil-absorbing pigment or an inorganic pigment, such as kaolin, talc and/or calcium carbonate, is added, followed by admixing of polymer particles having an average particle size of from 0.03 to 16 microns, such as ethylene-α-olefin copolymer particles, low density polyethylene particles, or ethylene-vinyl acetate copolymer particles, according to the invention. If desired, a thermofusible compound having the property of fusing when heated during image recording, a metal soap such as zinc stearate, calcium stearate, aluminum stearate, etc., a wax such as paraffin wax, carnaubo wax, microcrystalline wax, fatty acid amide, etc. and so forth may also be added.

Most generally, the coating mixture prepared above is applied to a base paper.

Such paper is generally coated with the coating mixture in an amount (solids) of from 2 to 10 g/m$^2$. The lower limit of the amount of the coating mixture depends on the density of the color developed upon heating while the upper limit is determined mainly by economic restrictions.

The following examples illustrate the invention. They are, however, by no means limitative of the invention.

EXAMPLE 1–5

An electron-donating colorless dyes (5 g) as set forth in Table 1 was dispersed in 50 g of a 5% aqueous solution of polyvinyl alcohol (degree of saponification-99%; degree of polymerization-1,000) in a ball mill for 24 hours. Separately, 20 g of an electron-accepting compound as set forth in Table 1 was similarly dispersed in 200 g of 5% aqueous polyvinyl alcohol for 24 hours. These two dispersions were blended, and 20 g of calcium carbonate was added and caused to disperse to a sufficient extent, followed by the addition of 10 g of ethylene-α-olefin copolymer (Mitsui Petrochemical Industries' TUFMER: divided and dispersed to an average particle size of 0.05–12 μm). There was thus prepared a coating mixture.

A base paper having a basis weight of 50 g/m$^2$ was coated with the above coating mixture so that the coating mixture was applied on the paper in the amount (solid) of 7 g/m$^2$. The resulting paper was calendered to obtain a coated paper.

COMPARATIVE EXAMPLE 1

A coated paper was produced in the same manner as Example 1, except that a fraction having an average particle size of 0.015 μm was separated from the ethylene-α-olefin copolymer and used.

COMPARATIVE EXAMPLE 2

A coated paper was produced in the same manner as Example 1 except that a fraction having an average particle size of 20 μm was separated from the ethylene-α-olefin copolymer and used.

COMPARATIVE EXAMPLE 3

A coated paper was produced in the same manner as Example 1 except that the ethylene-α-olefin copolymer particles were used in an amount of 60% by weight based on the total solids in the coating mixture.

COMPARATIVE EXAMPLE 4

A coated paper was produced in the same manner as Example 1 except that the ethylene-α-olefin copolymer particles were used in an amount of 2.5% by weight based on the total solids in the coating mixture.

COMPARATIVE EXAMPLE 5

A coated paper was produced in the same manner as Example 1 except that paraffin wax particles (10 g, average particles size 4.0 μm) were added in place of the ethylene-α-olefin copolymer particles.

COMPARATIVE EXAMPLE 6

A coated paper was produced in the same manner as Example 1 except that the coating mixture was prepared without the addition of the ethylene-α-olefin copolymer.

The heat-sensitive recording materials produced above in Examples 1–5 and Comparative Examples 1–6 were tested for resistance to fogging due to friction.

They were further subjectd to test printing, i.e., color development, and were evaluated with respect to the sensitivity and the preservability of the image produced.

D. The rate of retention of the image after storage at 60° C. for 24 hours and at 50° C. and 90% RH for 24 hours is less than 80%.

TABLE 1

| Example No. | Electron-Donating Colorless Dye | Electron-Accepting Compound | Additive | Addition Level (wt %) | Average Particle Size | Frictional Fogging | Sensitivity | Image Retention |
|---|---|---|---|---|---|---|---|---|
| Example | | | | | | | | |
| 1 | Crystal violet lactone | Bisphenol A | Ethylene-α-olefin copolymer | 15 | 4.3 | A | A | A |
| 2 | 2-Anilino-3-fluoro-6-diethylaminofluoran | Bisphenol A | Ethylene-α-olefin copolymer | 15 | 0.05 | A | A | A |
| 3 | 2-Anilino-3-methyl-6-diethylaminofluoran | Benzyl 4-hydroxybenzoate | Ethylene-α-olefin copolymer | 15 | 12 | A | A | A |
| 4 | 2-Anilino-3-methyl-6-diethylaminofluoran | Benzyl 4-hydroxybenzoate | Ethylene-α-olefin copolymer | 45 | 4.3 | A | A | A |
| 5 | 2-Anilino-3-methyl-6-diethylaminofluoran | Bisphenol A | Ethylene-αolefin copolymer | 5 | 4.3 | A | A | A |
| Comparative Example | | | | | | | | |
| 1 | Crystal violet lactone | Bisphenol A | Ethylene-α-olefin copolymer | 15 | 0.015 | B | A | A |
| 2 | Crystal violet lactone | Bisphenol A | Ethylene-α-olefin copolymer | 15 | 20 | A | C | A |
| 3 | Crystal violet lactone | Bisphenol A | Ethylene-α-olefin copolymer | 60 | 4.3 | A | C | A |
| 4 | Crystal violet lactone | Bisphenol A | Ethylene-α-olefin copolymer | 2.5 | 4.3 | B | A | A |
| 5 | Crystal violet lactone | Bisphenol A | Paraffin | 15 | 4.0 | C | A | A |
| 6 | Crystal violet lactone | Bisphenol A | — | — | — | D | A | A |

The results thus obtained are shown in Table 1. The evaluation criteria were as follows:

Frictional fogging

A. Rubbing of the heat-sensitive paper sheet on a glass sheet or the like hard body hardly causes color development.

B. Rubbing on a glass sheet or the like causes slight color development but rubbing on a paper board or the like soft body hardly causes color development.

C. Rubbing on a paper board or the like causes slight color development.

D. Rubbing on a paper board or the like causes color development.

Sensitivity

A. The decrease in sensitivity as compared with the case where no additive is added is less than 5%.

C. The decrease in sensitivity as compared with the case where no additive is added is 5% or more but less than 10%.

D. The decrease in sensitivity as compared with the case where no additive is added is 10% or more.

Image Retention or Preservability

A. The rate of retention of the image after storage at 60° C. for 24 hours and at 50° C. and 90% RH for 24 hours is not less than 95%.

C. The rate of retention of the image after storage at 60° C. for 24 hours and at 50° C. and 90% RH for 24 hours is not less than 80% but less than 95%.

The results given in Table 1 indicates that the heat-sensitive recording materials according to the invention have very good resistance to frictional fogging.

EXAMPLES 6–10

An electron-donating colorless dye (5 g) as set forth in Table 2 was dispersed in 50 g of a 5% aqueous solution of polyvinyl alcohol (degree of saponification-99%; degree of polymerization-1,000) in a ball mill for 24 hours. Separately, 20 g of an electron-accepting compound as set forth in Table 2 was similarly dispersed in 200 g of 5% aqueous polyvinyl alcohol solution for 24 hours. These two dispersions were blended, and 20 g of calcium carbonate was added and caused to sisperse to a sufficient extent, followed by the addition of 10 g of low density polyethylene (Mitsui Polychemical's MINALIN; divided and dispersed to an average particle size of 0.05–12 μm). There was thus prepared a coating mixture.

A base paper having a basis weight of 50 g/m$^2$ was coated with the above coating mixture so that the solids applied to the paper amounted to 7 g/m$^2$. The paper was calendered to obtain a coated paper.

COMPARATIVE EXAMPLE 7

A coated paper was produced in the same manner as Example 6 except that a fraction having an average particle size of 0.02 μm was separated from the low density polyethylene and used.

COMPARATIVE EXAMPLE 8

A coated paper was produced in the same manner as Example 6 except that a fraction having an average particle size of 23 μm was separated from the low density polyethylene and used.

COMPARATIVE EXAMPLE 9

A coated paper was produced in the same manner as Example 6 except that the low density polyethylene particles were used in an amount of 60% by weight based on the total solids in the coating mixture.

COMPARATIVE EXAMPLE 10

A coated paper was produced in the same manner as Example 6 except that the low density polyethylene particles were used in an amount of 2.5% by weight based on the total solids in the coating mixture.

COMPARATIVE EXAMPLE 11

A coated paper was produced in the same manner as Example 1 except that high density polyethylene particles (10 g, density 0.96 g/cm$^3$, average particles size 5.2 μm) were added in place of the low density polyethylene particles.

COMPARATIVE EXAMPLE 12

A coated paper was produced in the same manner as Example 6 except that the coating mixture was prepared without the addition of the low density polyethylene particles.

The heat-sensitive recording materials produced above in Examples 6–10 and Comparative Examples 7–12 were tested for resistance to frictional fogging. They were further subjected to test printing, i.e., color development, and were evaluated with respect to the sensitivity and the preservability of the image produced. The results thus obtained are shown in Table 2. The criteria used for the evaluation with respect to frictional fogging, sensitivity and image preservability were the same as those used in the tests the results of which are shown in Table 1.

TABLE 2

| Example No. | Electron-Donating Colorless Dye | Electron-Accepting Compound | Additive | Addition Level (wt %) | Average Particles Size | Frictional Fogging | Sensitivity | Image Retention |
|---|---|---|---|---|---|---|---|---|
| Example | | | | | | | | |
| 6 | Crystal violet lactone | Bisphenol A | Low density polyethylene | 15 | 4.8 | A | A | A |
| 7 | 2-Anilino-3-chloro-6-diethylaminofluoran | Bisphenol A | Low density polyethylene | 15 | 0.10 | A | A | A |
| 8 | 2-Anilino-3-methyl-6-diethylaminofluoran | Benzyl 4-hydroxybenzoate | Low density polyethylene | 15 | 13 | A | A | A |
| 9 | 2-Anilino-3-methyl-6-diethylaminofluoran | Benzyl 4-hydroxybenzoate | Low density polyethylene | 45 | 4.3 | A | A | A |
| 10 | 2-Anilino-3-methyl-6-diethylaminofluoran | Benzyl 4-hydroxybenzoate | Low density polyethylene | 5 | 4.8 | A | A | A |
| Comparative Example | | | | | | | | |
| 7 | Crystal violet lactone | Bisphenol A | Low density polyethylene | 15 | 0.02 | B | A | A |
| 8 | Crystal violet lactone | Bisphenol A | Low density polyethylene | 15 | 23 | A | C | A |
| 9 | Crystal violet lactone | Bisphenol A | Low density polyethylene | 60 | 4.3 | A | C | A |
| 10 | Crystal violet lactone | Bisphenol A | Low density polyethylene | 2.5 | 4.3 | C | A | A |
| 11 | Crystal violet lactone | Bisphenol A | High density polyethylene | 15 | 5.2 | C | C | A |
| 12 | Crystal violet lactone | Bisphenol A | High density polyethylene | — | — | D | A | A |

The results given in Table 2 indicates that the heat-sensitive recording materials according to the invention have very good resistance to frictional fogging.

EXAMPLES 11–15

An electron-donating colorless dye (5 g) as set forth in Table 3 was dispersed in 50 g of a 5% aqueous solution of polyvinyl alcohol (degree of saponification-99%; degree of polymerization-1,000) in a ball mill for 24 hour. Separately, 20 g of an electron-accepting compound as set forth in Table 3 was similarly dispersed in 200 g of 5% aqueous polyvinyl alcohol solution for 24 hours. These two dispersions were blended, and 20 g of calcium carbonate was added and caused to disperse to a sufficient extent, followed by the addition of 10 g of ethylene-vinyl acetate copolymer (Mitsui Polychemical's EVAFLEX: divided and dispersed to an average particles size of 0.05–12 μm). There was thus prepared a coating mixture.

A base paper having a basis weight of 50 g/m$^2$ was coated with the above coating mixture so that the solids applied to the paper amounted to 7 g/m$^2$. The paper was calendered to obtain a coated paper.

COMPARATIVE EXAMPLE 13

A coated paper was produced in the same manner as Example 11 except that a fraction having an average particle size of 0.015 μm was separated from the ethylenevinyl acetate copolymer and used.

COMPARATIVE EXAMPLE 14

A coated paper was produced in the same manner as Example 11 except that a fraction having an average particle size of 20 μm was separated from the ethylenevinyl acetate copolymer and used.

COMPARATIVE EXAMPLE 15

A coated paper was produced in the same manner as Example 11 except that the ethylene-vinyl acetate copolymer particles were used in an amount of 60% by weight based on the total solids in the coating mixture.

COMPARATIVE EXAMPLE 16

A coated paper was produced in the same manner as Example 11 except that the ethylene-vinyl acetate copolymer particles were used in an amount of 2.5% by weight based on the total solids in the coating misture.

COMPARATIVE EXAMPLE 17

A coated paper was produced in the same manner as Example 11 except that paraffin wax particles (10 g, average particle size 4.0 μm) were added in place of the ethylene-vinyl acetate copolymer particles.

COMPARATIVE EXAMPLE 18

A coated paper was produced in the same manner as Example 1 except that the coating mixture was prepared without the addition of the ethylene-vinyl acetate copolymer.

The heat-sensitive recording materials produced above in Examples 11–15 and Comparative Examples 13–18 were tested for resistance to frictional fogging. They were further subjected to test printing, i.e., color development, and were evaluated with respect to the sensitivity and the preservability of the image produced. The results thus obtained are shown in Table 3. The criteria used for the evaluation with respect to frictional fogging, sensitivity and image preservability were the same as those used in the tests the result of which are shown in Table 1.

TABLE 3

| Example No. | Electron-Donating Colorless Dye | Electron-Accepting Compound | Wax Added | Addition Level (wt %) | Average Particle Size of Wax | Frictional Fogging | Sensitivity | Image Retention |
|---|---|---|---|---|---|---|---|---|
| Example | | | | | | | | |
| 11 | Crystal violet lactone | Bisphenol A | Ethylene-vinyl acetate copolymer | 15 | 3.9 | A | A | A |
| 12 | 2-Anilino-3-chloro-6-diethylaminofluoran | Bisphenol A | Ethylene-vinyl acetate copolymer | 15 | 0.04 | A | A | A |
| 13 | 2-Anilino-3-methyl-6-diethylaminofluoran | Benzyl 4-hydroxybenzoate | Ethylene-vinyl acetate copolymer | 15 | 15 | A | A | A |
| 14 | 2-Anilino-3-methyl-6-diethylaminofluoran | Benzyl 4-hydroxybenzoate | Ethylene-vinyl acetate copolymer | 45 | 3.9 | A | A | A |
| 15 | 2-Anilino-3-methyl-6-diethylaminofluoran | Bisphenol A | Ethylene-vinyl acetate copolymer | 5 | 3.9 | A | A | A |
| Comparative Example | | | | | | | | |
| 13 | Crystal violet lactone | Bisphenol A | Ethylene-vinyl acetate copolymer | 15 | 0.015 | B | A | A |
| 14 | Crystal violet lactone | Bisphenol A | Ethylene-vinyl acetate copolymer | 15 | 21 | A | C | A |
| 15 | Crystal violet lactone | Bisphenol A | Ethylene-vinyl acetate copolymer | 60 | 3.9 | A | C | A |
| 16 | Crystal violet lactone | Bisphenol A | Ethylene-vinyl acetate copolymer | 2.5 | 3.9 | B | A | A |

TABLE 3-continued

| Example No. | Electron-Donating Colorless Dye | Electron-Accepting Compound | Wax Added | Addition Level (wt %) | Average Particle Size of Wax | Frictional Fogging | Sensitivity | Image Retention |
|---|---|---|---|---|---|---|---|---|
| 17 | Crystal violet lactone | Bisphenol A | Paraffin | 15 | 4.0 | C | A | A |
| 18 | Crystal violet lactone | Bisphenol A | — | — | — | D | A | A |

The results given in Table 3 indicates that the heat-sensitive recording materials according to the invention have very good resistance to frictional fogging.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a heat-sensitive recording layer containing an electron-donating colorless dye and an electron-accepting compound, said heat-sensitive layer being provided on a support base, and said heat-sensitive layer containing from 5 to 50% by weight, based on the total weight of the heat-sensitive layer-constituting component, of polymer particles having an average particles size of from 0.03 to 16 microns, selected from the group consisting of ethylene-$\alpha$-olefin copolymer particles, low density polyethylene particles, and ethylene-vinyl acetate copolymer particles.

2. A heat-sensitive recording material as in claim 1, wherein the heat-sensitive layer contains said polymer particles in an amount of from 5 to 15% by weight.

3. A heat-sensitive recording material as in claim 2, wherein said polymer particles have an average particle size of from 0.5 to 5 microns.

4. A heat-sensitive recording material as in claim 3, wherein the heat-sensitive recording layer is provided in an amount of from 2 to 10 g/m$^2$.

5. A heat-sensitive recording material as in claim 2, wherein the heat-sensitive recording layer is provided in an amount of from 2 to 10 g/m$^2$.

6. A heat-sensitive recording material as in claim 1, wherein said polymer particles have an average particle size of from 0.5 to 5 microns.

7. A heat-sensitive recording material as in claim 6, wherein the heat-sensitive recording layer is provided in an amount of from 2 to 10 g/m$^2$.

8. A heat-sensitive recording material as in claim 1, wherein the heat-sensitive recording layer is provided in an amount of from 2 to 10 g/m$^2$.

* * * * *